US007104933B1

(12) United States Patent
Liao

(10) Patent No.: US 7,104,933 B1
(45) Date of Patent: Sep. 12, 2006

(54) ROWER

(75) Inventor: Hsueh-Sen Liao, Hsin-Chu Hsien (TW)

(73) Assignee: Hsin Lung Accessories Co., Ltd., Hsin-Chu Hsein (TW)

( * ) Notice: Subject to any disclaimer, the term of this patent is extended or adjusted under 35 U.S.C. 154(b) by 0 days.

(21) Appl. No.: 11/088,820

(22) Filed: Mar. 25, 2005

(51) Int. Cl.
*A63B 69/06* (2006.01)

(52) U.S. Cl. ..... 482/72; 482/114; 482/121

(58) Field of Classification Search ..... 482/114, 482/115, 118, 119, 72, 73, 95, 96, 133, 140, 482/148; D21/674
See application file for complete search history.

(56) References Cited

U.S. PATENT DOCUMENTS 4,606,538 A * 8/1986 Wang ..... 482/73
4,743,010 A * 5/1988 Geraci ..... 482/72
5,104,363 A * 4/1992 Shi ..... 482/73
5,512,027 A * 4/1996 Chen ..... 482/72
5,575,741 A * 11/1996 Fan ..... 482/72
6,533,710 B1 * 3/2003 Lin et al. ..... 482/123

* cited by examiner

*Primary Examiner*—Stephen R. Crow
*Assistant Examiner*—Allana Lewin
(74) *Attorney, Agent, or Firm*—Troxell Law Office, PLLC

(57) ABSTRACT

A rower is comprised of a seat on a base, a stepper disposed on the other rend of the base and an oar provided between the seat and the stepper, the stepper being linked to the oar by means of a linkage, a return device being disposed between the base and the linkage for the user to sit on the seat to practice rowing and doing the stretching of muscles of the extremities by the resistance from the stepper.

9 Claims, 10 Drawing Sheets

ROWER

BACKGROUND OF THE INVENTION (a) Field of the Invention

The present invention is related to a rower of fitness equipment, and more particularly to a collapsible rower for its user to exercise stretching of extremities at the same time.

(b) Description of the Prior Art

Generally, fitness equipment such as a walker, a stationary bike, or a rower simulates the motions that would have been done outdoors so to allow the user to work out within a confined area attempting to achieve the same fitness results given outdoors. For example, a walker simulates stepper allows the user to alternatively tread on a pair of pedals for achieving sports and exercise purposes.

Referring to FIG. 1 of the accompanying drawings for an exploded view of a rower of the prior art, a sliding seat 11 is provided on a base 10 at one end and two levers 12 respectively disposed at the other end on both sides of the sliding seat 11; an arm 14 mounted with a hydraulic resistance 13 extends from the tail of each lever 12; and an oar 15 connected to the hydraulic resistance 13 is axially disposed to the tail of the arm 14.

The user sits on the sliding seat 11 with both hands holding both oars 15 to row and thus to exercise the muscles of both arms against the force produced by the hydraulic resistance. A track 16 is provided on the base 10 for the sliding seat 11 to travel back and forth and a foot support 17 is disposed at the distal end of the sliding seat 11 for the user to do stretching for both legs to improve the workout results of the extremities.

However, a comparatively larger space is required for the oars 15 to swing for simulating the rowing motion. Therefore the arm 14 is needed in providing sufficient space for the oars to operate. Accordingly, the rower of the prior art occupies quite a large area. Furthermore, for reducing storage space of the rower after the use, screws fastening the arm 14 to the lever 12 must be loosened up to remove the arm 14.

The removal after each use and the reassembly before each use of the arm 14 may well frustrate the desire of the user to work out with the rower. The hydraulic resistance 13 is comparatively expensive and prevented from adjustment of its resistance as desire.

SUMMARY OF THE INVENTION

The primary purpose of the present invention is to provide a rower for its user to train muscles of both arms and stretching of both legs at the same time. To achieve the purpose, a seat is provided at one end and a stepper on the other end of a base; a pair of oars is disposed between the seat and the stepper; both of the stepper and the pair of the oars are connected by means of a linkage; and a return device is disposed at where between the base and the linkage. Accordingly, the user sitting on the seat holds the pair of oars to do the rowing with both arms and do the stretching with both legs by taking advantage of the motion in opposite direction created by the linkage of the stepper.

Furthermore, a resistance adjustment is adapted to the linkage to adjust the resistance as desired.

DETAILED DESCRIPTION OF THE PREFERRED EMBODIMENTS

Figure 1:
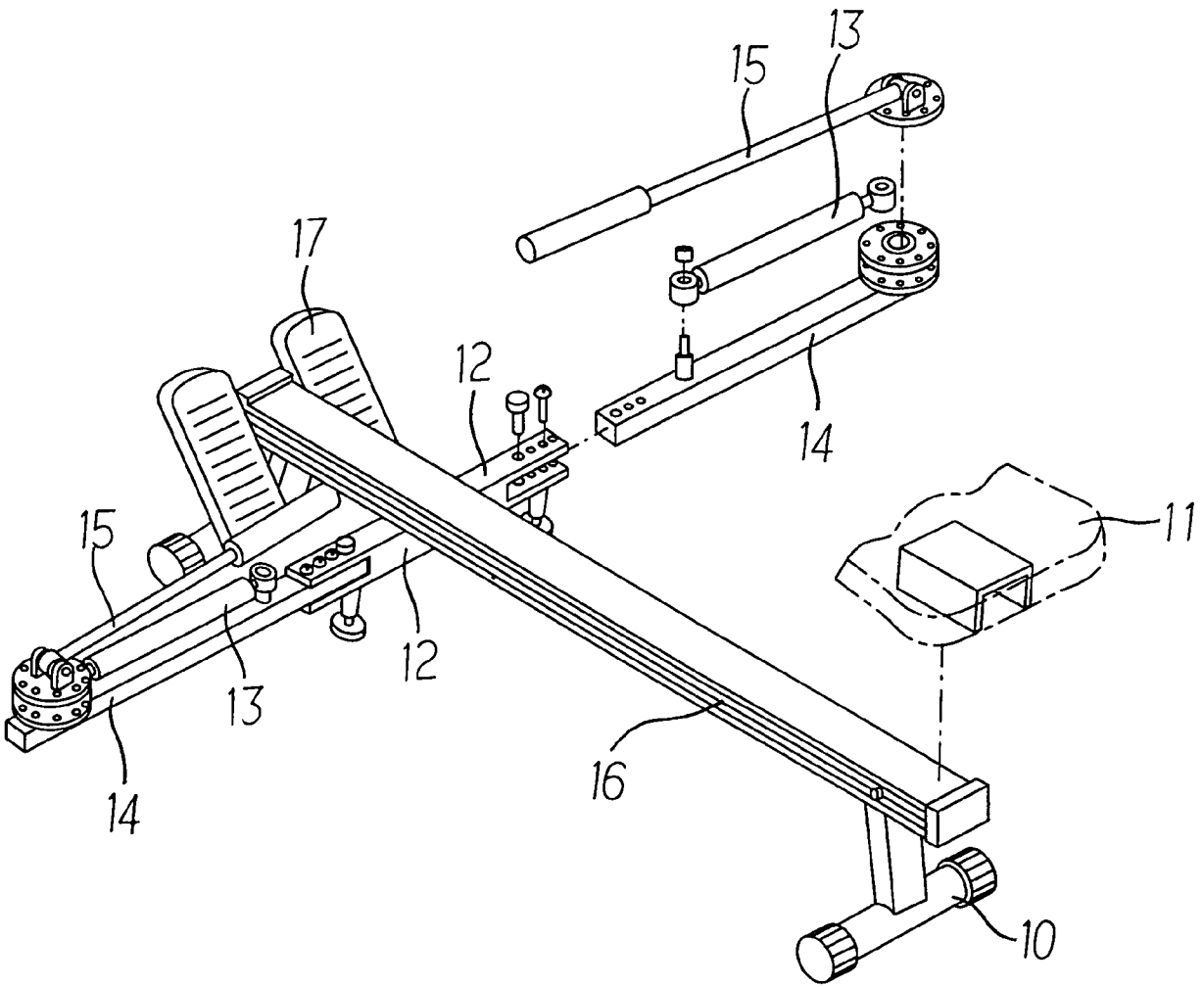
FIG.1 Prior Art
FIG. 1 is an exploded view of a rower of the prior art.
Figure 2:
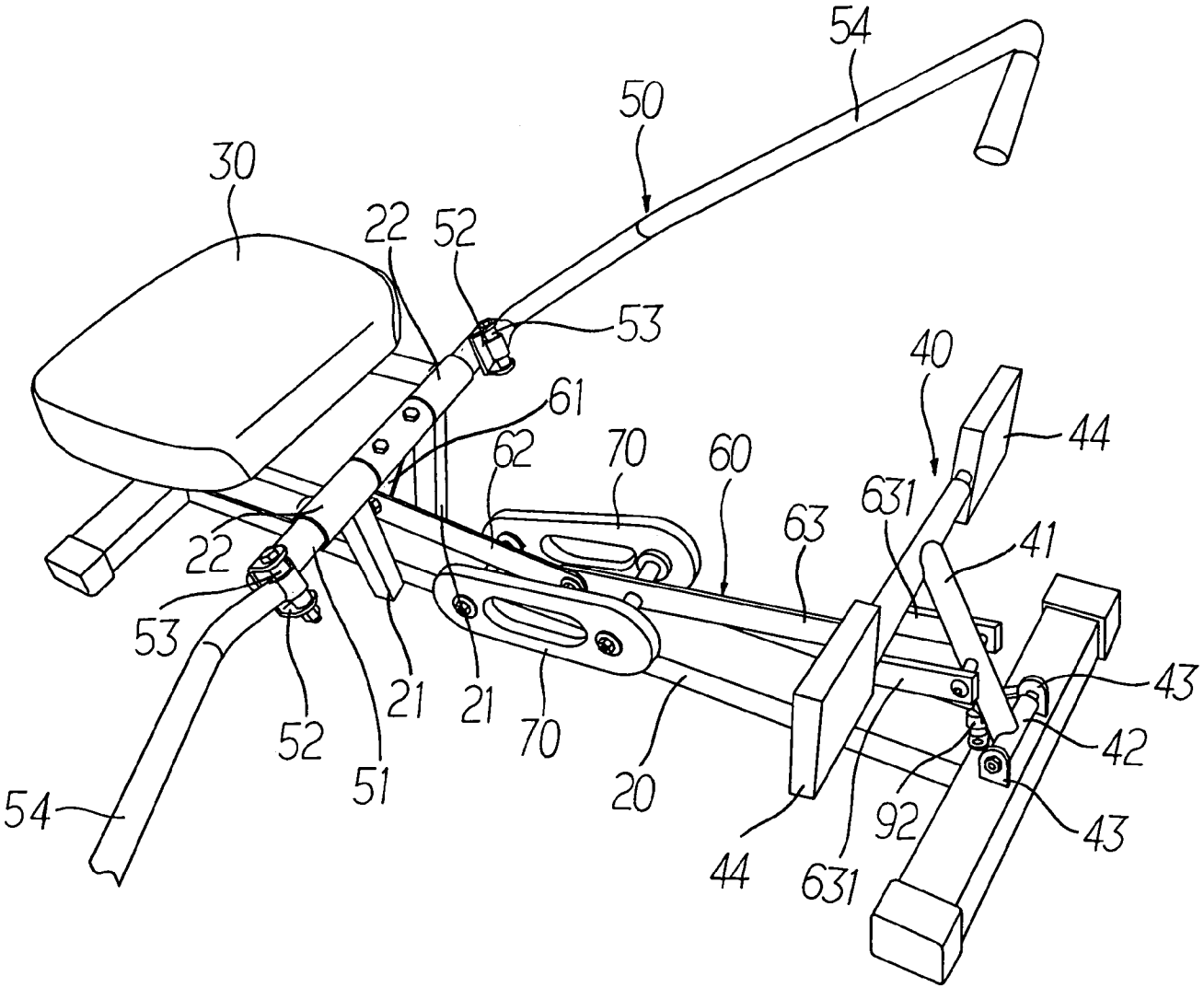
FIG. 2 is a perspective view of a rower of the present invention.
Figure 3:
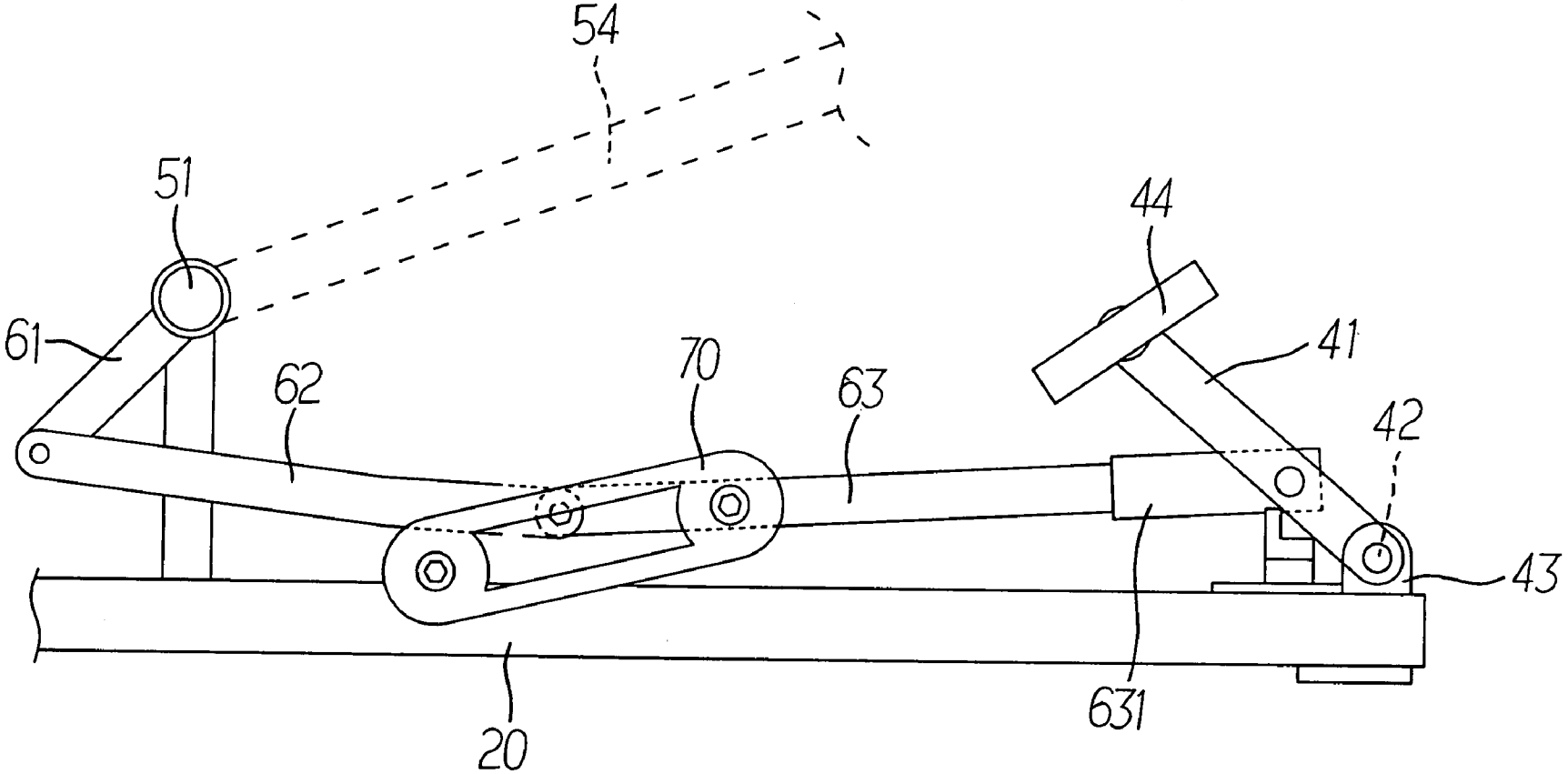
FIG. 3 is a schematic view showing the construction of the rower of the present invention.

Referring to FIGS. 2 and 3, a rower of fitness equipment of the present invention is essentially comprised of a seat 30 at one end and a stepper 40 at the other end of the stepper of a base 20; a pair of oars 50 is separately disposed between the seat 30 and the stepper 40; and both of the stepper 40 and the pair of oars 50 are linked to each other by means of a linkage 60.

Wherein, a pair of vertical rods are disposed at the proximate end of the seat 30 on the base 20 for mounting the pair of oars 50. A tube 22 is laterally adapted to the vertical rod 21. The tube 22 is inserted with a spindle 51 and a holder 52 in a "ㄷ" shape is fixed to the tail of the spindle 51 and a pivot 53 is provided at the opening of the holder 52, and a rowing arm 54 is inserted onto the pivot 53. The linkage is axially disposed below the spindle 51 with a first connection rod 61. The other end of the first connection rod 61 is connected in sequence to a second connection rod 62 and a third connection rod 63. A "ㄷ" shaped bracket 631 is disposed on the third connection rod 63 at the distal end to the second connection rod 62. The bracket 631 is connected to both sides of an activation rod 41 of the stepper 40. The activation rod 41 is fixed to a pivot 42 and the pivot 42 if fixed to the base 20 through the fixation holder 43. Two pedals 44 are respectively provided on both sides of the activation rod 41. One end of a return device 70 related to an elastic or any other device that provides return action) is fixed to the third connection rod 63 and another end of the return device 70 is fixed to the base 20.

Figure 4:
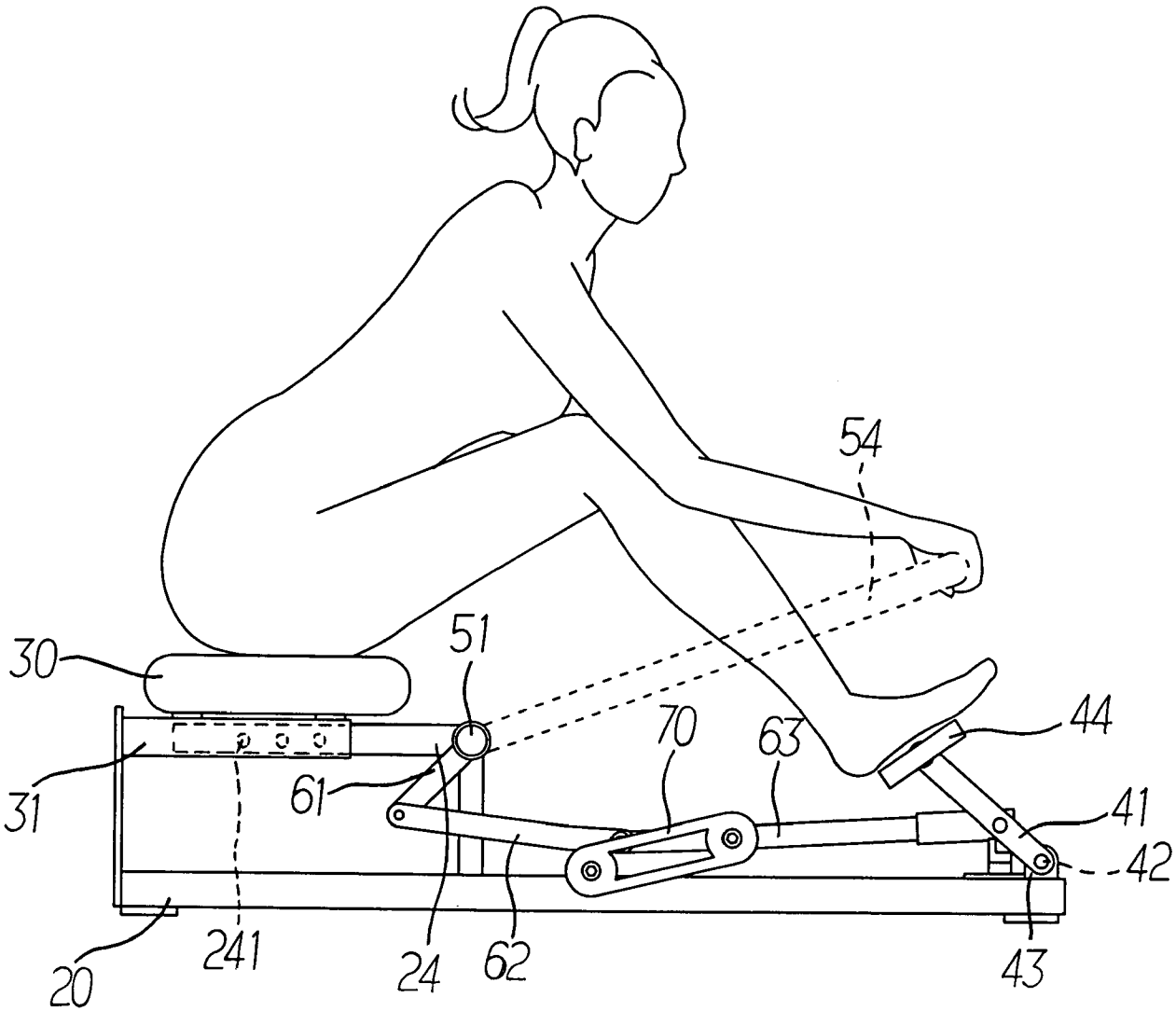
FIG. 4 is a schematic view showing the operation status of the rower of the present invention.
Figure 5:
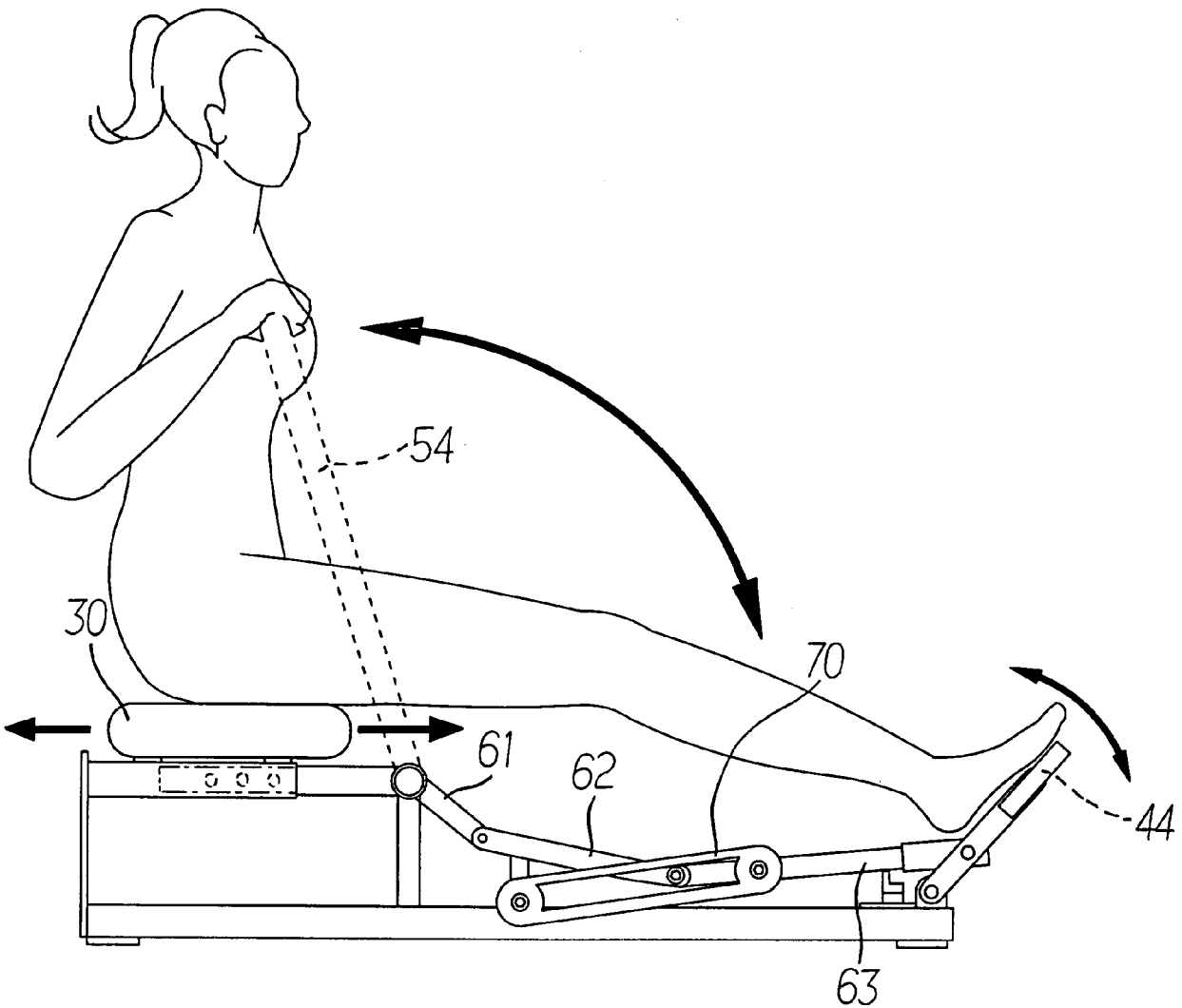
FIG. 5 is another schematic view showing the operation status of the rower of the present invention.

Now referring to FIGS. 4 and 5, the user sits on the seat 30 with both feet stepping onto the pedals 44 and both hands holding the rowing arms 54 to simulate rowing by taking advantage of the spindle 51 revolving in the lateral tube 22 and the pivot 53. While rowing, the spindle 51 transmit the kinetics through the first, the second, and the third connection rods 61, 62, 63 in sequence to the activation rod 41 for taking advantage of the pivoting from the pivot 42 for both pedals 44 to produce motion in opposite direction to the swing of the rowing arm 54; and the return device 70 provides the returning elasticity for both of the rowing arms 54 and both pedals 44 for the user to do stretching exercises for the muscles of his extremities.

Figure 6:
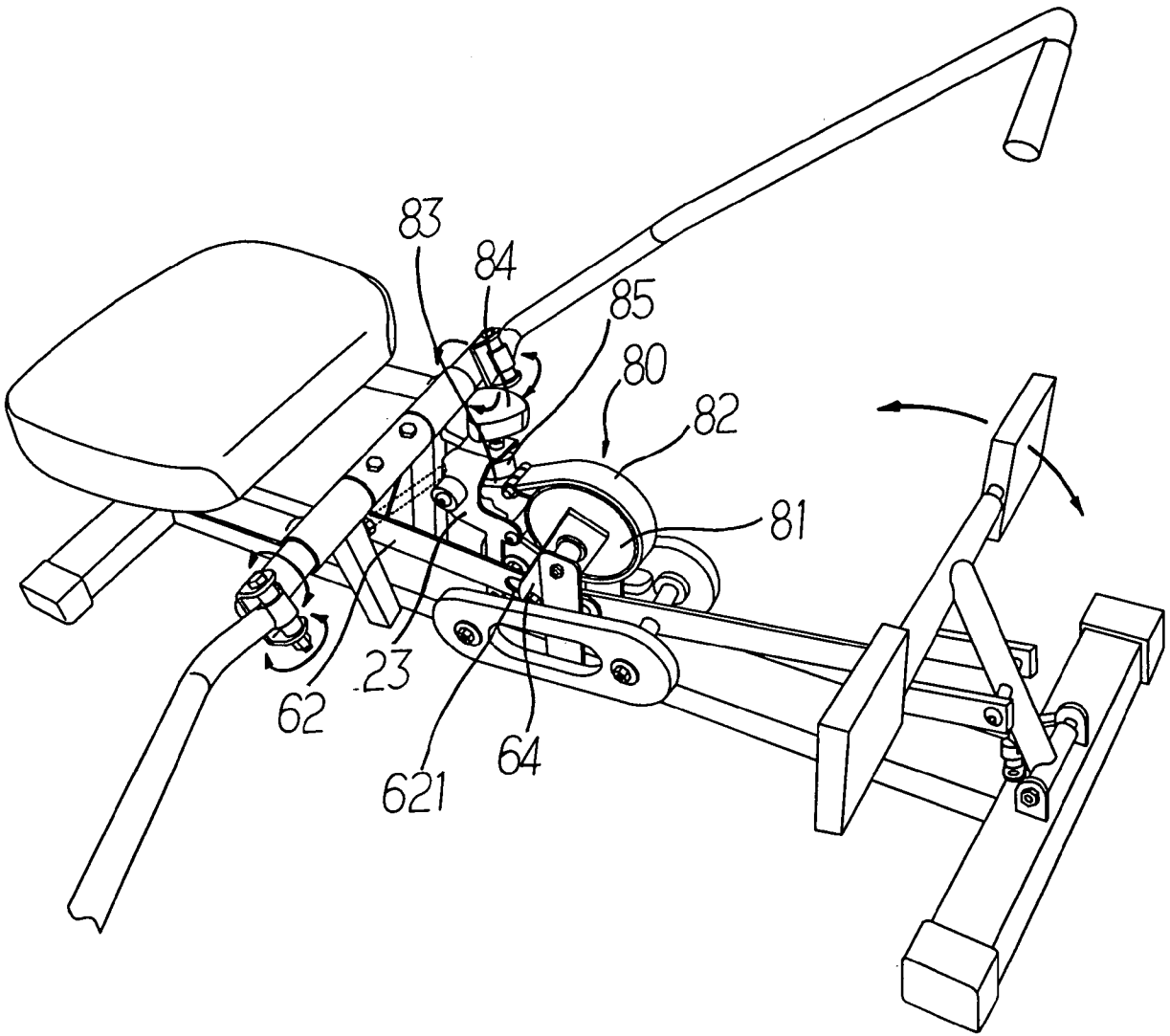
FIG. 6 is another perspective view of the rower of the present invention.
Figure 7:
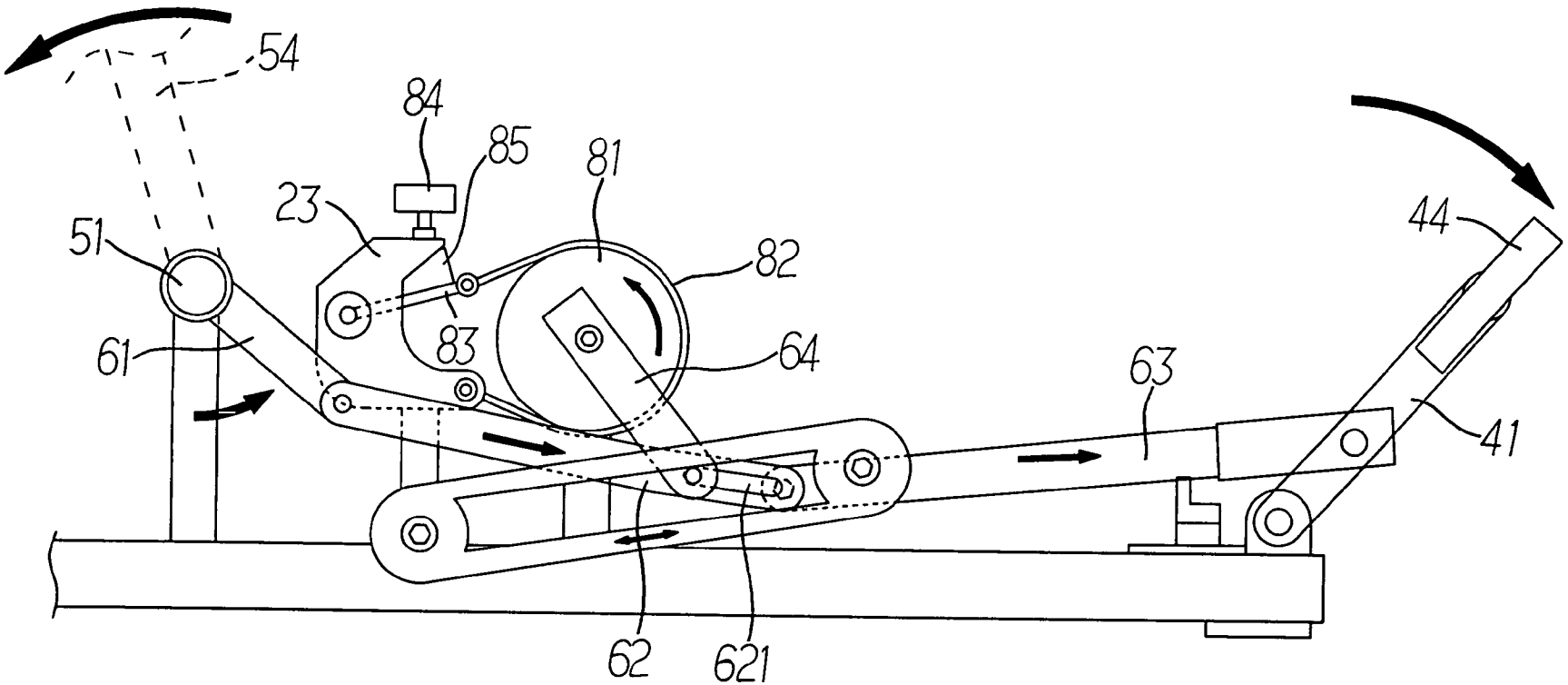
FIG. 7 is another schematic view showing the construction of the rower of the present invention.

Furthermore, as illustrated in FIGS. 6 and 7, a slot 621 is provided to the second connection rod 62 close to the third connection rod 63 for mounting a fourth connection rod 64. One end of the fourth rod 64 is allowed to travel in the slot 621 and the other end of the fourth rod 64 is adapted with a rotor 81 of a resistance adjustment 80. The resistance adjustment 80 is pivoted with the rotor 81 to the base 20. The outer circumference of the rotor 81 is disposed with a friction plate 82 to contact the rotor 81. As the user is doing the rowing exercise by holding both rowing arms 54, the kinetics are transmitted by the spindle 51 to the activation rod 41 through the first, the second, and the third connection rods 61, 62, 63 and the fourth connection rod 64 laterally travels in the slot 621 for the rotor 81 adapted to the fourth connection rod 64 to produce for both rowing arms 54 the resistance from the friction by contacting the friction plate 82 while the fourth connection rod 64 travels in the slot 621 to press against both ends of the slot 621 and reciprocally rotate.

Figure 8:
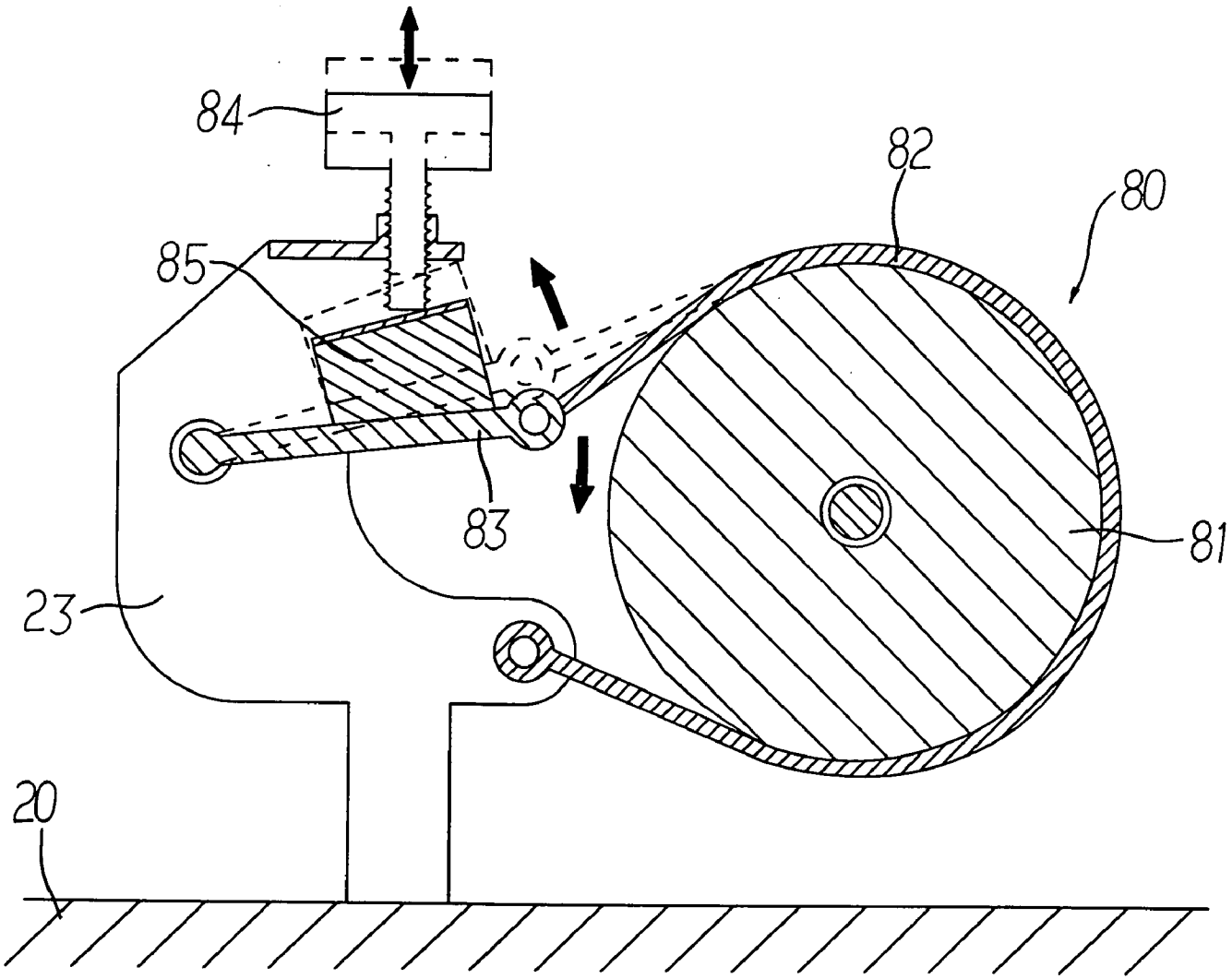
FIG. 8 is a schematic view showing a resistance adjustment of the rower of the present invention.

One end of the friction plate 82 of the resistance adjustment 80 is fixed to a fixation plate 23 of the base 20; and the other end of the friction plate 82 is fixed to the fixation plate 23 by means of an adjustment plate 83. An adjustment bolt 84 is fastened to the fixation plate 23 in relation to one end of the adjustment plate 83; and a pad 85 is disposed between the adjustment plate 83 and the adjustment bolt 84. Accordingly, the amplitude of the friction force between the rotor 81 and the friction plate 82 is adjusted by turning the adjustment bolt 84. As illustrated in FIG. 8, when the adjustment bolt 84 is tuned counter-clockwise, the pad 85 descends to press against the adjustment plate 83 for the friction plate 82 at the other end of the adjustment plate 83 to get closer to the rotor 81, thus to increase the contact area and pressure between the friction plate 82 and the rotor 81 to increase friction force and the resistance to the rowing exercise.

Figure 10:
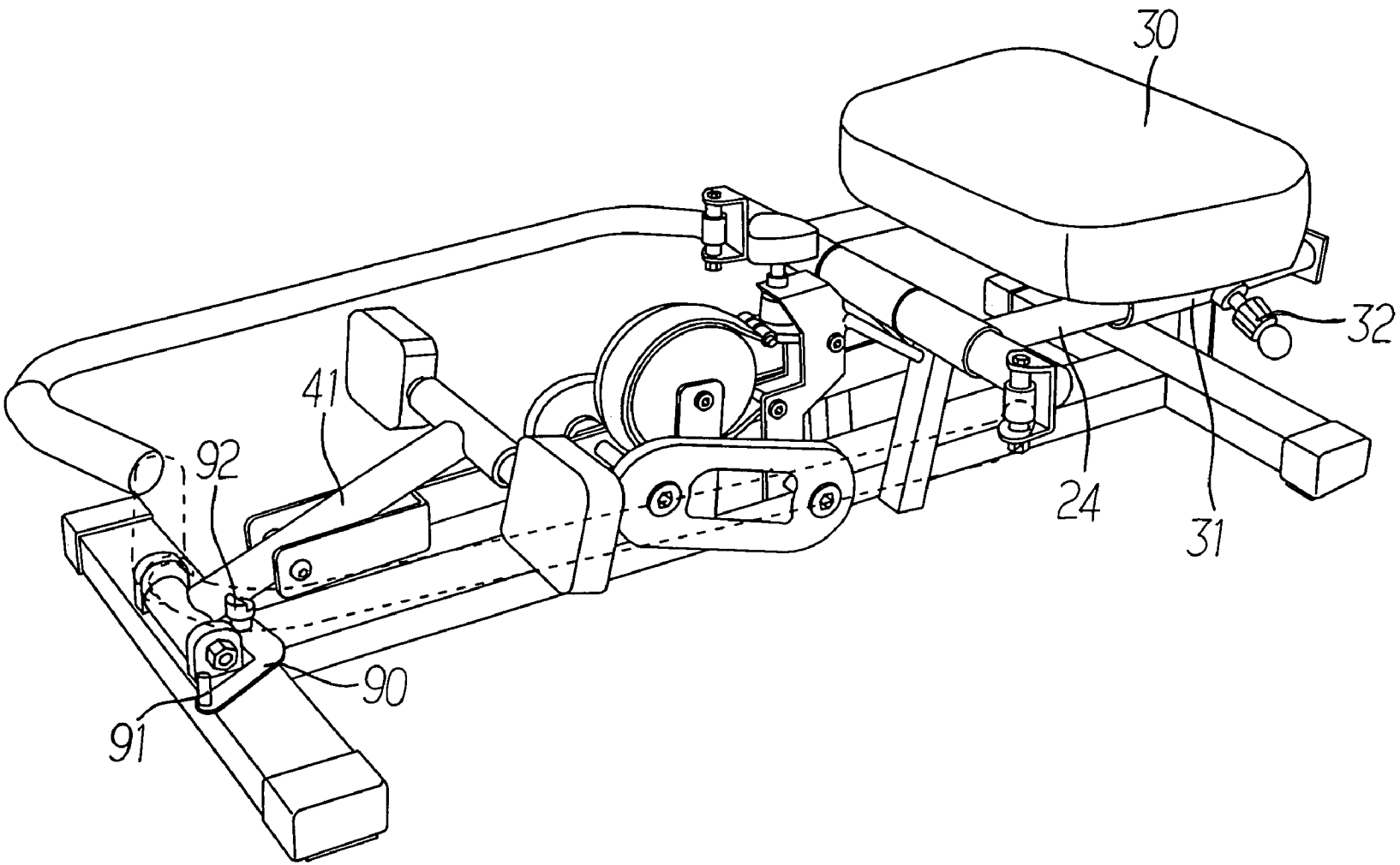
FIG. 10 is a schematic view showing the collapsed status of the rower of the present invention.

The seat is fixed to a rod 24 disposed over the base 20 as illustrated in FIGS. 4 and 10. The seat 30 is adapted with a tube 31 inserted to the rod 24. Multiple positioning holes 241 are provided on the rod 24; a positioning rod 32 is disposed the tube 31 is inserted to the rod 24; one end of the positioning rod 32 is exposed out of the tube 31; an elastic member (not illustrated) is provided between the positioning rod 32 and the tube 31 to push the positioning rod 32 into the tube 31; and one end of the positioning rod 32 penetrating through the tube 31 is locked in the positioning hole 241 on the rod 24 to secure both of the rod 24 and the tube 31 in position. Meanwhile, the adjustment of the lateral position of the seat 30 can be fast done by inserting the positioning rod 32 into a selected positioning hole 241 of the tube 24.

Figure 9:
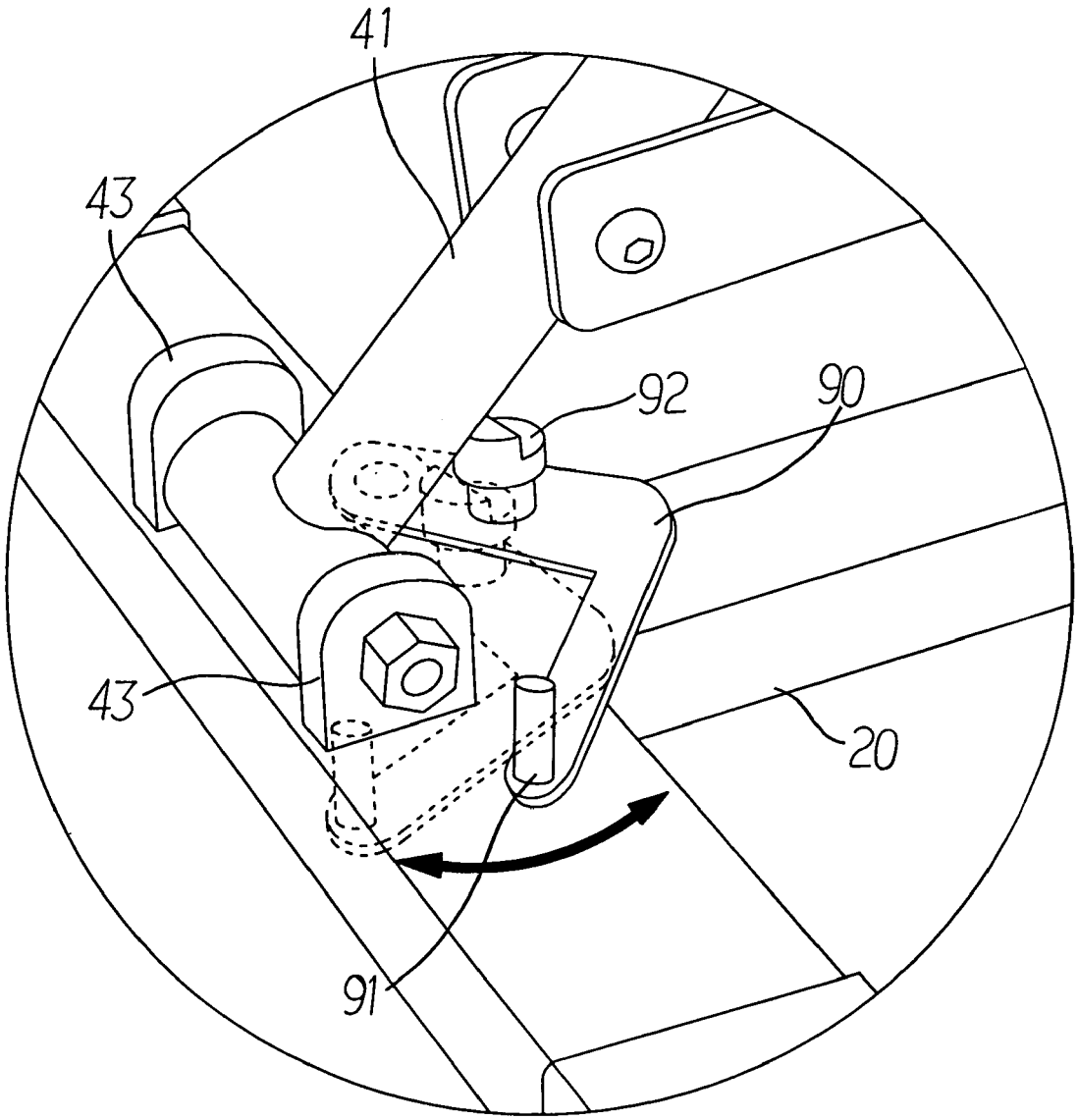
FIG. 9 is a schematic view showing the construction of a rotor and an activation rod of the rower of the present invention.

Another rotor 90 is provided on one side of the fixation holder 43 for the base 20 as illustrated in FIG. 9. Wherein, one end of the rotor 90 is axially provided to the base 20 close to the pivot 42 and another end of the rotor is provided with a push rod 91. A locking block 92 is disposed appropriately on the rotor 90 for the rotor 90 to fix the locking block 92 below the activation rod 41 as illustrated in FIG. 6. Alternatively, the push rod 91 is pushed to move the rotor 90 to close up the activation rod 41 as illustrated in FIG. 10 for the user to easily collapse the rower for storage.

The prevent invention provides an improved construction of a rower of fitness equipment; and the application for a utility patent is duly filed accordingly. However, it is to be noted that that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A rower of fitness equipment for stretching exercises of extremities at the same time includes:

a base, having at one end mounted with a seat and another end disposed with a stepper, a pair of oars being separately provided between the seat and the stepper, and both of the stepper and the pair of oars being connected with a linkage;

a seat, provided at one end of the base for the user to sit on;

a pair of oars, mounted on a vertical rod provided on the base close to the seat, a lateral tube laterally mounted to the vertical rod, a spindle being inserted into the lateral tube, a rowing arm being pivoted to the tail of the spindle, and the oar being connected to a stepper by means of a connection rod;

a linkage, having a first connection rod axially disposed below the spindle at one end, and connected to an activation rod of the stepper at the other end by means of a second and a third connection rods;

the stepper, axially disposed by the activation rod to the base in relation to the distal end of the seat, and a pair of pedals being respectively provided on both sides of the activation rod; and a return device, having one end fixed to the linkage and the other end fixed to the base.

2. The rower of claim 1, wherein, the seat is fixed to a rod disposed over the base, a tube being provided to the seat to be inserted to the rod, multiple positioning holes being disposed on the rod, a positioning rod being provided the tube is inserted to the rod, one end of the positioning rod being exposed out of the tube, an elastic member being disposed between the positioning rod and the tube to push the positioning rod into the tube to be inserted into the positioning hole desired for fast adjusting the lateral position of the seat.

3. The rower of claim 1, wherein, the tail of the spindle is fixed with a ⊏ shaped fixation holder, a pivot is pivoted to the opening of the fixation holder, and a rowing arm is inserted to the pivot.

4. The rower of claim 1, wherein, one end of the third connection rod is made into a ⊏ shaped bracket for the third connection rod to be connected to both sides of the activation rod.

5. The rower of claim 1, wherein, the activation rod is fixed to a pivot and the pivot is fixed to the base by means of a fixation holder.

6. The rower of claim 1, wherein, the activation rod is fixed to a pivot, the pivot being fixed to the base by means of a fixation holder, a rotor being disposed on one side of the fixation holder; one end of the rotor being axially provided to the base close to the pivot; another end of the rotor being provided with a push rod; a locking block being provided appropriately on the rotor;

and the push rod being pushed to move the rotor for the locking block to be secured below the push rod.

7. The rower of claim 1, wherein, the return device is related to an elastic member having one end fixed to the third connection rod.

8. A rower of fitness equipment for stretching exercises of extremities at the same time includes:

a base, having at one end mounted with a seat and another end disposed with a stepper, a pair of oars being separately provided between the seat and the stepper, and both of the stepper and the pair of oars being connected with a linkage;

a seat, provided at one end of the base for the user to sit on;

a pair of oars, mounted on a vertical rod provided on the base close to the seat, a lateral tube laterally mounted to the vertical rod, a spindle being inserted into the lateral tube, a rowing arm being pivoted to the tail of the spindle, and the oar being connected to a stepper by means of a connection rod;

a linkage, having a first connection rod axially disposed below the spindle at one end, and connected to an activation rod of the stepper at the other end by means of a second and a third connection rods, a slot being provided on the second connection rod close to the third connection rod for the mounting of a fourth connection rod, one end of the fourth connection rod traveling in the slot, and a resistance adjustment being adapted to the other end of the fourth connection rod;

the stepper, axially disposed by the activation rod to the base in relation to the distal end of the seat, and a pair of pedals being respectively provided on both sides of the activation rod; and a return device, having one end fixed to the linkage and the other end fixed to the base.

9. The rower of claim 8, wherein, the resistance adjustment is comprised of a rotor pivoted to the base, a friction plate being provided with its outer circumference of the rotor, both of the rotor and the friction plate contacting each other, one end of the friction plate being fixed to a fixation holder of the base and another end of the friction plate being fixed to a fixation holder by means of an adjustment plate; an adjustment bolt being fastened to the fixation plate in relation to one end of the adjustment plate, and the friction between the rotor and the friction plate being adjusted by turning the bolt.

* * * * *